US011078616B2

(12) United States Patent
Ryu et al.

(10) Patent No.: US 11,078,616 B2
(45) Date of Patent: Aug. 3, 2021

(54) WASHING MACHINE

(71) Applicant: SAMSUNG ELECTRONICS CO., LTD., Suwon-si (KR)

(72) Inventors: Myung-Hee Ryu, Suwon-si (KR); Kyoung Woo Lee, Suwon-si (KR); Dong-Won Kim, Suwon-si (KR); Yongjie Jin, Suwon-si (KR); Jun Hong Park, Yongin-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 95 days.

(21) Appl. No.: 16/462,113

(22) PCT Filed: Nov. 9, 2017

(86) PCT No.: PCT/KR2017/012666
§ 371 (c)(1),
(2) Date: May 17, 2019

(87) PCT Pub. No.: WO2018/117416
PCT Pub. Date: Jun. 28, 2018

(65) Prior Publication Data

US 2019/0330781 A1 Oct. 31, 2019

(30) Foreign Application Priority Data

Dec. 23, 2016 (KR) ..... 10-2016-0178595

(51) Int. Cl.

| | |
|---|---|
| ***D06F 37/26*** | (2006.01) |
| ***D06F 25/00*** | (2006.01) |
| ***D06F 58/02*** | (2006.01) |
| ***D06F 58/26*** | (2006.01) |

(52) U.S. Cl.
CPC ..... *D06F 37/267* (2013.01); *D06F 25/00* (2013.01); *D06F 58/02* (2013.01); *D06F 58/26* (2013.01)

(58) Field of Classification Search
CPC ..... D06F 37/267; D06F 25/00; D06F 58/02; D06F 58/26
USPC ..... 68/12.15
See application file for complete search history.

(56) References Cited

U.S. PATENT DOCUMENTS

2006/0123854 A1* 6/2006 Hong ..... D06F 58/22 68/19.1
2008/0244922 A1 10/2008 Kim et al.
2008/0276656 A1 11/2008 Kitamura et al.
(Continued)

FOREIGN PATENT DOCUMENTS

CN 105696290 A 6/2016
CN 106149276 11/2016
EP 2 281 934 A1 2/2011
(Continued)

OTHER PUBLICATIONS

Communication pursuant to Article 94(3) EPC dated Apr. 9, 2020, in corresponding European Patent Application 17203523.0.
(Continued)

*Primary Examiner* — Tinsae B Ayalew
(74) *Attorney, Agent, or Firm* — Staas & Halsey LLP

(57) ABSTRACT

Disclosed is a washing machine including a drying function. Here, a height of a bottom end of a dryer disposed above a tub is lower than a height of a top end of the tub to have a space for integrating other devices having additional functions above the tub.

8 Claims, 11 Drawing Sheets

(56) References Cited

U.S. PATENT DOCUMENTS

| | | | |
|---|---|---|---|
| 2014/0047869 | A1 | 2/2014 | Kim et al. |
| 2014/0223971 | A1 | 8/2014 | Hong et al. |

FOREIGN PATENT DOCUMENTS

| | | | |
|---|---|---|---|
| EP | 2 471 994 | A1 | 7/2012 |
| EP | 3 026 168 | A1 | 6/2016 |
| EP | 3026168 | | 6/2016 |
| EP | 3 088 596 | A1 | 11/2016 |
| JP | 2010-94206 | | 4/2010 |

OTHER PUBLICATIONS

Communication Pursuant to Article 94(3) EPC, dated Aug. 28, 2019, in European Patent Application No. 17203523.0

First Office Action, dated Oct. 9, 2019, in Chinese Patent Application No. 201711403684.X.

European Search Report dated Apr. 25, 2018, in European Patent Application No. 17203523.0.

International Search Report dated Mar. 6, 2018, in corresponding International Patent Application No. PCT/KR2017/012666.

International Written Opinion dated Mar. 6, 2018, in corresponding International Patent Application No. PCT/KR2017/012666.

European Office Action dated Feb. 12, 2019, in European Patent Application No. 17 203 523.0.

Communication pursuant to Article 94(3) EPC dated Nov. 12, 2020, in corresponding European Patent Application No. 17 203 523.0.

Chinese Office Action dated Sep. 10, 2020 in corresponding Chinese Patent Application No. 201711403684.X.

* cited by examiner

WASHING MACHINE

CROSS-REFERENCE TO RELATED APPLICATIONS

This application is a U.S. National Stage Application which claims the benefit under 35 U.S.C. § 371 of PCT International Patent Application No. PCT/KR2017/012666, filed Nov. 9, 2017, which claims the foreign priority benefit under 35 U.S.C. § 119 of Korean Application No. 10-2016-0178595 filed Dec. 23, 2016, the contents of which are incorporated herein by reference.

TECHNICAL FIELD

Embodiments of the present disclosure relate to a washing machine, and more particularly, to a washing machine which includes a washer having a drying function and other devices having additional functions.

BACKGROUND ART

Generally, a washing machine is an apparatus which washes laundry by rotating a cylindrical drum in which the laundry is accommodated. Washing machines include a washing machine which washes laundry by horizontally disposing a drum such that laundry is lifted upward along an inner circumference of the drum and falls down when the drum rotates on a horizontal axis and a washing machine in which a drum including a pulsator is vertically disposed and which washes laundry using water currents generated by the pulsator when the drum rotates on a vertical axis.

The washing machine including the horizontally disposed drum is referred to as a front-loading washing machine due to a laundry insertion hole formed at a front thereof. The washing machine including the vertically disposed drum is referred to as a top-loading washing machine due to a laundry insertion hole formed at a top thereof.

Also, a washing machine may include a dryer which blows air to an accommodating space in which laundry is accommodated by using heat of a drying heater and dries the laundry, may separately perform a drying function by using the dryer, and may perform the drying function after completing spin-drying in connection with a washing function.

In general, since a dryer is located above a tub and a flow path of hot air which moves toward an inside of the tub is formed in a vertical direction, there is a limitation in providing a space for integrating other devices having additional functions above the tub.

DISCLOSURE

Technical Problem

Therefore, it is an aspect of the present disclosure to provide a washing machine in which a placement and a structure of a dryer are improved to provide a space for integrating other devices having additional functions above a tub.

It is another aspect of the present disclosure to provide a washing machine which includes a washer having a dryer and another washer.

Additional aspects of the present disclosure will be set forth in part in the description which follows and, in part, will be obvious from the description, or may be learned by practice of the present disclosure.

Technical Solution

In accordance with one aspect of the present disclosure, a washing machine includes a housing, a tub disposed in the housing, a drum disposed to be rotatable in the tub, and a dryer configured to supply hot air to an inside of the drum and disposed above an outside of the tub to deviate toward one side to allow a height of a bottom end thereof to be lower than a height of a top end of the tub.

The dryer may include a blowing fan which suctions in air in the rear of the tub and blows the air toward a front of the tub, a heater which heats the air suctioned in by the blowing fan, a case in which the blowing fan and the heater are disposed, and a blowing duct connected to a bottom of a front of the case and formed to be inclined to move toward a center of an opening disposed in front of the tub.

The case may include a lower cover and an upper cover. Here, the blowing duct may be connected to a front of the lower cover and a bottom of the upper cover, and the upper cover may include a drawing part provided at an end near the blowing duct and recessed toward the blowing duct.

The upper cover may include a blowing fan cover disposed near the blowing fan and a heater cover disposed near the heater, and the heater cover including the drawing part may include a metal material.

The washing machine may further include a spring which connects an outer surface of the tub to a top of the housing. Here, the case of the dryer may include a concave part provided to guide a blowing direction of the blowing fan, and the spring may be disposed to pass an outside of the concave part of the case.

The dryer may be disposed to be inclined to allow the blowing fan and the case to be parallel to a tangential direction of the opening of the tub.

The dryer may be disposed to allow a height of a top end thereof to be lower than the height of the top end of the tub.

The washing machine may further include a connector which connects the dryer to the tub. Here, the connector may include an inside air inlet into which air in the tub flows and an outside air inlet into which air in the housing flows, and a height of a bottom surface of the outside air inlet may be formed to be lower than a height of a bottom surface of the inside air inlet.

The washing machine may further include a suction hose which connects the inside air inlet of the connector to the tub, and a residual water drain hose which connects the bottom surface of the outside air inlet of the connector to the suction hose.

In accordance with one aspect of the present disclosure, a washing machine includes a first housing with an open top, a second housing mounted on the first housing and with an open bottom, a tub disposed in the first housing, a drum installed to be rotatable in the tub, and a dryer configured to supply hot air to an inside of the drum and disposed above an outside of the tub to deviate toward one side to allow a height of a bottom end thereof to be lower than a height of a top end of the tub.

The washing machine may include another tub disposed in the second housing. Here, the dryer may be disposed between the tub disposed in the first housing and the other tub disposed in the second housing.

The washing machine may include at least one of a hand-washer, a laundry box, an automatic detergent insertion device, and a clothes dryer, in the second housing.

The first housing may include a side panel which forms a side surface of the first housing, and the dryer may be disposed to be adjacent to the side panel.

The tub may include a cylindrical shape with an opening for inserting laundry at one surface and is disposed to allow the opening to face forward, and the dryer may be disposed in a space formed between an outer surface of the tub and the side panel.

In accordance with one aspect of the present disclosure, a washing machine includes a first tub which includes an opening for inserting laundry at a front thereof, a second tub which includes an opening for inserting laundry at a top thereof and is disposed above the first tub, and a dryer disposed between the first tub and the second tub and configured to supply hot air to the first tub.

Advantageous Effects

A washing machine according to one embodiment of the present disclosure, in which a dryer is disposed to deviate toward one side and a height of a bottom end thereof is lower than a height of a top end of a tub such that a space for integrating other devices having additional functions above the tub is secured.

The washing machine may include a plurality of washers such that laundry can be separately washed as necessary.

DESCRIPTION OF DRAWINGS

These and/or other aspects of the present disclosure will become apparent and more readily appreciated from the following description of the embodiments, taken in conjunction with the accompanying drawings of which.

MODE FOR INVENTION

Figure 1:
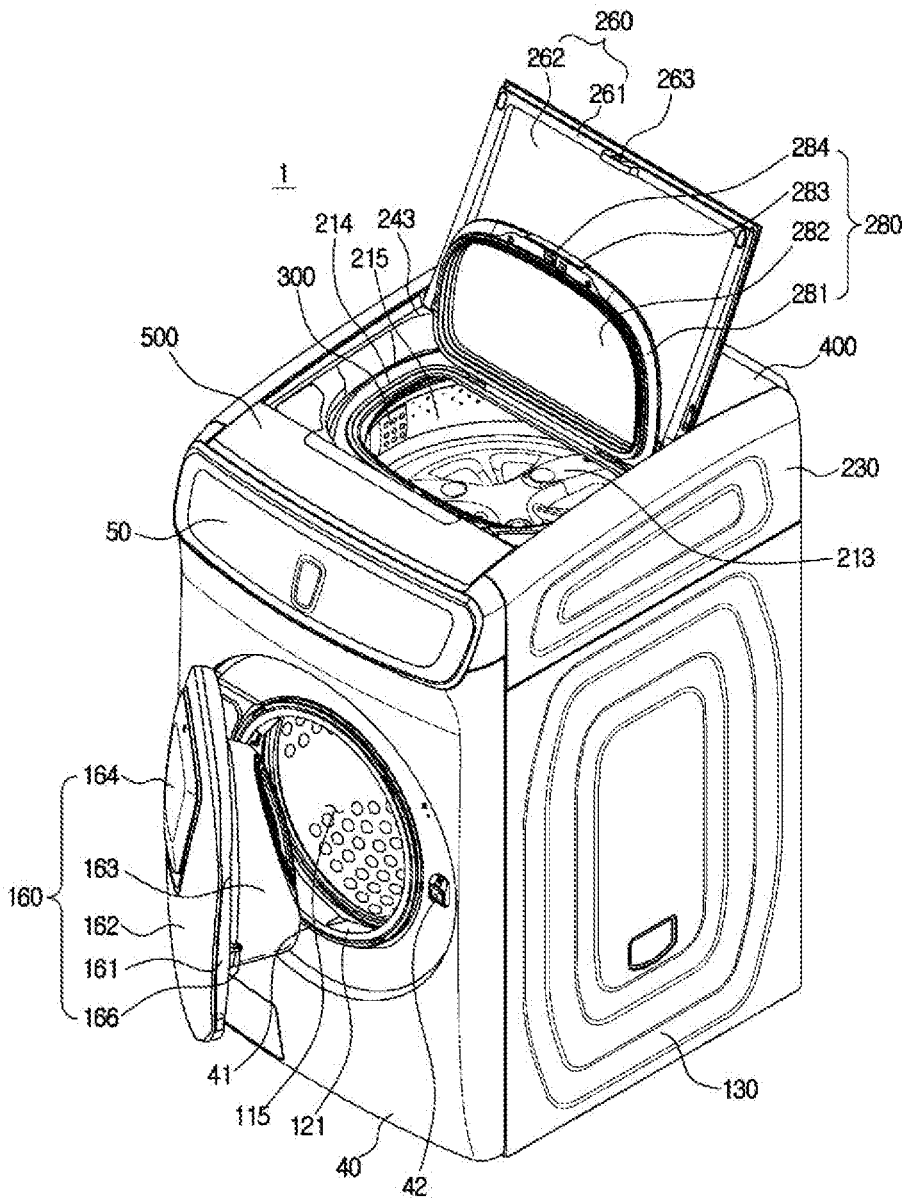
FIG. 1 is a perspective view of a washing machine according to an embodiment of the present disclosure.

Embodiments disclosed in the specification and components shown in the drawings are merely preferable examples of the present disclosure and various modifications capable of replacing the embodiments and drawings of the specification may be made at the time of filing the present application.

Also, throughout the drawings of the present specification, like reference numerals or symbols refer to components or elements configured to perform substantially identical functions.

Also, the terms used herein are to explain the embodiments but are not intended to limit and/or define the present disclosure. Singular forms, unless defined otherwise in context, include plural forms. Throughout the specification, the terms "comprise", "have", and the like are used herein to specify the presence of stated features, numbers, steps, operations, elements, components or combinations thereof but do not preclude the presence or addition of one or more other features, numbers, steps, operations, elements, components, or combinations thereof.

Also, even though the terms including ordinals such as "first", "second", and the like may be used for describing various components, the components will not be limited by the terms and the terms are used only for distinguishing one element from others. For example, without departing from the scope of the present disclosure, a first component may be referred to as a second component, and similarly, the second component may be referred to as the first component. The term "and/or" includes any and all combinations or one of a plurality of associated listed items.

Hereinafter, the embodiments will be described in detail with reference to the attached drawings.

Figure 2:
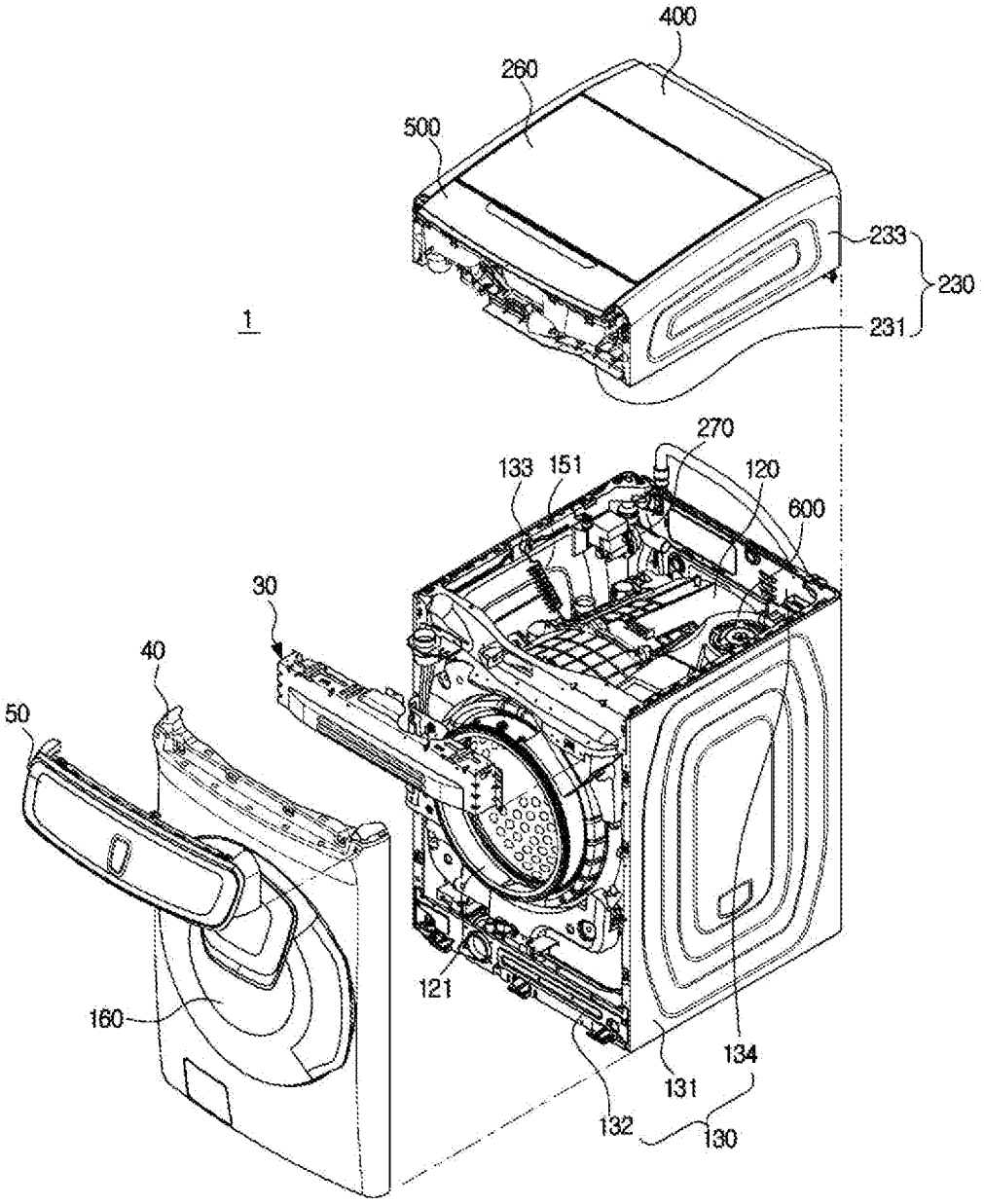
FIG. 2 is an exploded view illustrating some components of the washing machine shown in FIG. 1.
Figure 3:
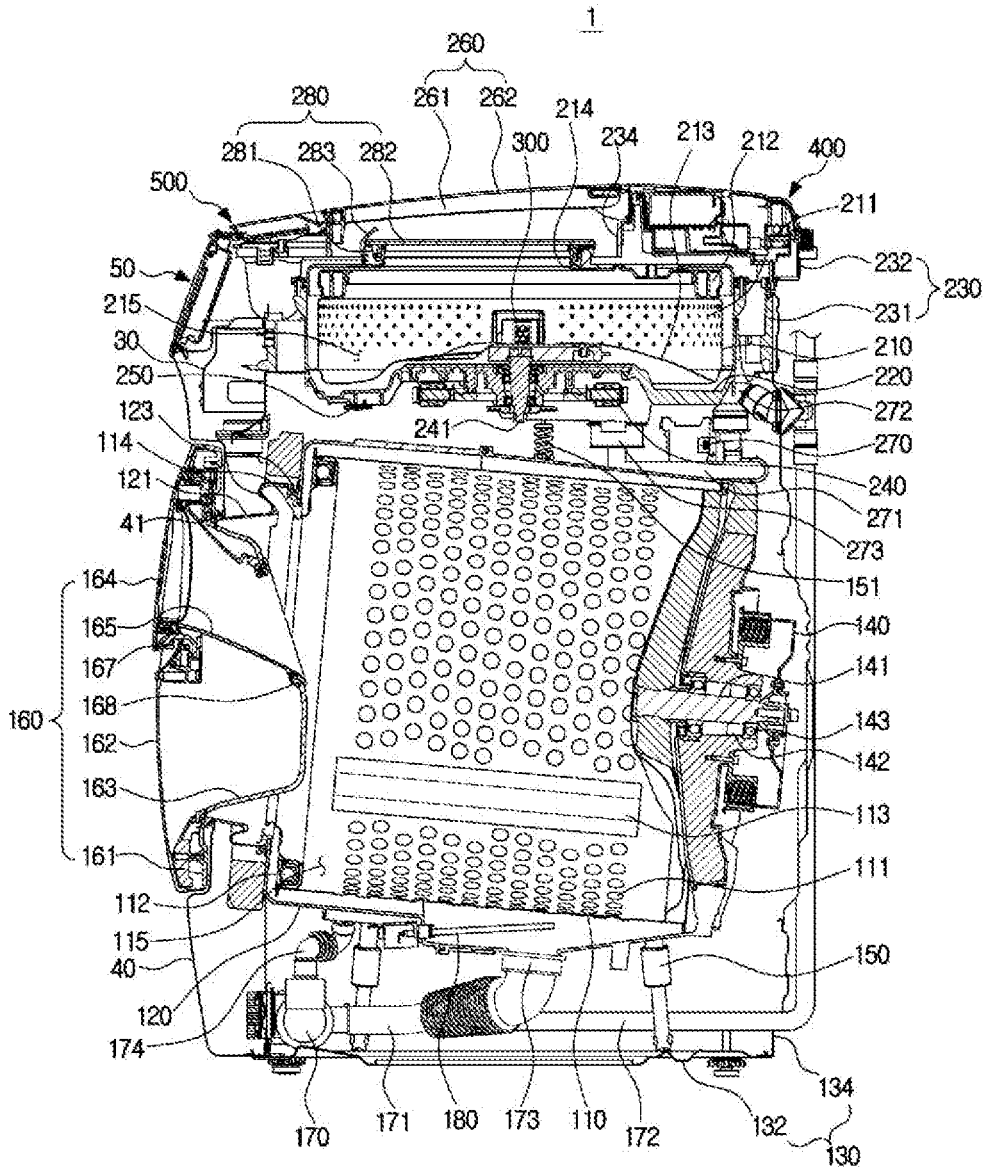
FIG. 3 is a cross-sectional view of the washing machine shown in FIG. 1.

FIG. 1 is a perspective view of a washing machine according to an embodiment of the present disclosure. FIG. 2 is an exploded view illustrating some components of the washing machine shown in FIG. 1. FIG. 3 is a cross-sectional view of the washing machine shown in FIG. 1.

As shown in FIGS. 1 to 3, a washing machine 1 may include a front-loading type first washer which includes a laundry insertion hole formed at a front of a first washing space 115 and a top-loading type second washer which includes a laundry insertion hole formed at a top of a second washing space 215. The first washer may include a dryer 600 which dries laundry accommodated in the first washing space 115.

The washing machine 1 may include a first drum 110 in which the first washing space 115 is formed and a first tub 120 which accommodates the first drum 110 and stores washing water or rinsing water to be used in a washing operation or a rinsing operation. The first drum 110 and the first tub 120 may have a cylindrical shape with at least partially opened one surface and may be disposed to allow the opened one surface to face frontward. In detail, the first drum 110 may include an opening 114 for inserting laundry at a front thereof, and the first tub 120 may include an opening 123 for inserting laundry at a front thereof.

The washing machine 1 may include a first housing 130 in which the first drum 110 and the first tub 120 are disposed. In detail, the first housing 130 with an open top may include a pair of first side panels 131 which form side surfaces of the first housing 130, a first rear panel 134 which forms a rear surface, and a bottom panel 132 which forms a bottom surface. The first side panels 131 and the first rear panel 134 may be integrated.

Also, the washing machine 1 may include a spring 151 and a damper 150, capable of supporting the first tub 120 to the first housing 130. The damper 150 may connect an outer surface of the first tub 120 to the bottom panel 132 to support the first tub 120 at a bottom thereof, and the spring 151 may connect the outer surface of the first tub 120 to spring couplers 133 provided at a top of the first side panels 131 to support the first tub 120 at a top thereof. The spring 151 and the damper 150 may buffer vibrations, noises, and shocks, which occur due to a movement of the first tub 120.

Installation positions of the spring 151 and the damper 150 are not limited to the top of the first side panels 131 and the bottom panel 132, and one surface of the first tub 120 and another part of the first housing 130 may be connected to support the first tub 120.

The washing machine 1 may include a first driving motor 140 disposed in the rear of the first tub 120 to rotate the first drum 110. A first driving shaft 141 for transmitting power of the first driving motor 140 may be connected to a rear surface of the first drum 110.

A plurality of through holes 111 for a flow of washing water may be formed at a circumference of the first drum 110. A plurality of lifters 113 may be installed at an inner circumferential surface of the first drum 110 to allow laundry to move upward and fall down when the first drum 110 rotates. A first balancer 112 may be mounted on a front of the first drum 110 to allow the first drum 110 to stably rotate during high-speed spinning.

The first driving shaft 141 may be disposed between the first drum 110 and the first driving motor 140. One end of the first driving shaft 141 is connected to a rear panel of the first drum 110, and the other end of the first driving shaft 141 is extended outward from a rear wall of the first tub 120. When the first driving motor 140 drives the first driving shaft 141, the first drum 110 connected to the first driving shaft 141 rotates around the first driving shaft 141.

A bearing housing 142 may be installed at the rear wall of the first tub 120 to rotatably support the first driving shaft 141. The bearing housing 142 may be formed of an aluminum alloy and may be inserted into the rear wall of the first tub 120 when the first tub 120 is injection-molded. Bearings 143 are installed between the bearing housing 142 and the first driving shaft 141 to allow the first driving shaft 141 to smoothly rotate.

The washing machine 1 may include a function of washing with water at high temperature. To obtain the water at high temperature, a heater 180 capable of heating washing water or rinsing water accommodated in the first tub 120 may be disposed at a bottom surface of the first tub 120.

The washing machine 1 may include a first drain pump 170 disposed below the first tub 120 to discharge water in the first tub 120 outward from the washing machine 1, a first connecting hose 171 which connects a first drain hole 173 of the first tub 120 to the first drain pump 170 to allow the water in the first tub 120 to flow into the first drain pump 170, a circulating hose 174 which connects the first drain pump 170 to the first tub 120 to circulate the water which flows into the first drain pump 170 through the first tub 120, and a first drain hose 172 which guides water pumped by the first drain pump 170 to the outside of the washing machine 1.

The washing machine 1 may include a front cover 40 at which a first insertion hole 41 for inserting laundry into the first washing space 115 is disposed, and a first door 160 for opening and closing the first insertion hole 41 may be coupled to the front cover 40.

The first door 160 may be provided corresponding to the first insertion hole 41 and may be provided to be pivotable with respect to the front cover 40. The first door 160 may include a first door frame 161, a first door cover 162, and door glass 163.

The first door frame 161 has an approximately annular shape in the embodiment but may have an approximately quadrangular shape. The first door cover 162 and the door glass 163 may be formed of transparent materials to allow an inside of the first drum 110 to be seen from the outside of the washing machine 1 even when the first door 160 closes the first insertion hole 41. The door glass 163 may be disposed to convexly protrude from the first door frame 161 toward the inside of the first drum 110. Through the configuration, the door glass 163 may be inserted into the first insertion hole 41 when the first door 160 is closed.

A first hinge is provided near the first insertion hole 41 and coupled to a first hinge coupler formed on one side of the first door frame 161 to allow the first door 160 to pivot with respect to the front cover 40. A first hook 166 is provided on the other side of the first door frame 161 and a first hook accommodating portion 42 is provided at the front cover 40 corresponding to the first hook 166 such that the first door 160 may remain in a state of closing the first insertion hole 41.

To insert laundry into the first washing space 115 even when the first door 160 is closed, the first door 160 may include an auxiliary laundry insertion hole 167 and an auxiliary door 164 for opening and closing the auxiliary laundry insertion hole 167. The auxiliary door 164 may be pivotably mounted on the first door cover 162.

To insert laundry into the washing machine 1 through the auxiliary laundry insertion hole 167 of the first door 160, it is necessary to allow the laundry to pass through the door glass 163. For this, the door glass 163 includes a glass through hole 168. As an alternative, it is possible to configure door glass not to be disposed in the rear of the auxiliary laundry insertion hole 167 by recessing a top of the door glass.

The first door 160 may include a connection guide 165 to connect the auxiliary laundry insertion hole 167 of the first door 160 to the glass through hole 168 of the door glass 163. The connection guide 165 may have a pipe shape with both ends open and a hollow.

In detail, one end of the connection guide 165 is connected to the auxiliary laundry insertion hole 167, and the other end is connected to the glass through hole 168. In the embodiment, the connection guide 165 may be tilted downward from a front to a rear. That is, the one end of the connection guide 165 connected to the auxiliary laundry insertion hole 167 may be at a position higher than that of the other end thereof. Through the configuration, a user may easily insert laundry into the first drum 110 through the auxiliary laundry insertion hole 167.

The first door 160 has been described as including the auxiliary door 164 in the embodiment but is not limited thereto. The first door 160 may be configured without an auxiliary laundry insertion hole, an auxiliary door, a connection guide, and the like.

The washing machine 1 may include a diaphragm 121 disposed between the first insertion hole 41 of the front cover 40 and the opening 123 of the first tub 120. The diaphragm 121 may form a path from the first insertion hole 41 to the opening 114 of the first drum 110 and reduce vibrations transferred to the front cover 40 during rotation of the first drum 110. Also, a part of the diaphragm 121 may be disposed between the first door 160 and the front cover 40 to prevent washing water in the first tub 120 from leaking outward from the washing machine 1.

The washing machine 1 may include a second drum 210 in which the second washing space 215 is formed and a second tub 220 which accommodates the second drum 210 and stores washing water or rinsing water to be used in a washing operation or a rinsing operation. The second drum 210 and the second tub 220 may have a cylindrical shape with at least partially opened one surface and may be disposed to allow the opened one surface to face upward.

The washing machine 1 may include a second housing 230 in which the second drum 210 and the second tub 220 are disposed and which includes an open bottom. In detail, the second housing 230 may include a lower frame 231 which includes a top and a bottom open and supports the second tub 220 and an upper frame 232 which includes a second insertion hole 234 for inserting laundry into the second washing space 215 and is mounted above the lower frame 231. Also, the second housing 230 may include side covers 233 which form exteriors of a left surface and a right surface.

The washing machine 1 may include a second door 260 disposed at the second housing 230 to open and close the second insertion hole 234. The second door 260 may be provided corresponding to the second insertion hole 234 and may be provided to be pivotable with respect to the upper frame 232. The second door 260 may include a second door frame 261 and a second door cover 262. The second door cover 262 may be formed of a transparent material to allow the second tub 220 and the second drum 210 to be seen from the outside of the washing machine 1 even when the second door 260 closes the second insertion hole 234.

To allow the second door 260 to pivot with respect to the upper frame 232, second hinges are provided at both left and right sides of the second door frame 261 and coupled to second hinge couplers formed around the second insertion hole 234. A latch accommodating portion 263 is provided at a front of the second door frame 261 and a latch device is provided at the upper frame 232 corresponding to the latch accommodating portion 263 of the second door frame 261 such that the second door 260 may remain in a state of closing the second insertion hole 234.

The second drum 210 may be provided to have a cylindrical shape with an open top and be disposed to be rotatable in the second tub 220. A plurality of second through holes 211 for a flow of washing water may be formed at side surfaces and a bottom surface of the second drum 210. A second balancer 212 may be mounted on a top of the second drum 210 to allow the second drum 210 to stably rotate during high-speed spinning. A filter 300 provided to filter out foreign substances which may occur during washing may be attached to an inner surface of the second drum 210.

A curve portion 213 for generating water currents may be formed at the bottom surface of the second drum 210. Although not shown in the drawings, the washing machine 1 may further include a pulsator disposed in the second drum 210 to generate water currents.

The second tub 220 may have a cylindrical shape and be supported by suspension devices 250 to the lower frame 231. In detail, the second tub 220 may be supported by four suspension devices 250 to be suspended from the lower frame 231. A third insertion hole 214 may be provided at a top surface of the second tub 220 corresponding to the second insertion hole 234, and a third door 280 for opening and closing the third insertion hole 214 may be coupled thereto.

The third door 280 may include a third door frame 281 and a third door cover 282. The third door cover 282 may be formed of a transparent material to allow an inside of the second drum 210 to be seen from an outside of the second tub 220 even when the third door 280 closes the third insertion hole 214.

A third hinge is provided near the third insertion hole 214 and coupled to a third hinge coupler formed at one side of the third door frame 281 to allow the third door 280 to pivot with respect to the second tub 220. A handle 283 capable of opening the third door 280 may be provided at the other side of the third door frame 281, and a second hook 284 may be provided at the handle 283. A second hook accommodating portion is provided at the second tub 220 corresponding to the second hook 284 such that the third door 280 may remain in a state of closing the third insertion hole 214. When the handle 283 is pulled, the second hook 284 may be separated from the second hook accommodating portion and open the third door 280.

The washing machine 1 may include a second driving motor 240 disposed outside a bottom of the second tub 220 to rotate the second drum 210. A second driving shaft 241 for transmitting power of the second driving motor 240 may be connected to the bottom surface of the second drum 210. One end of the second driving shaft 241 is connected to a bottom panel of the second drum 210, and the other end of the second driving shaft 241 is extended outward from a bottom wall of the second tub 220. When the second driving motor 240 drives the second driving shaft 241, the second drum 210 connected to the second driving shaft 241 rotates around the second driving shaft 241.

Although not shown in the drawings, when the pulsator is disposed at the bottom surface of the second drum 210, the washing machine 1 may further include a power switching device to simultaneously or selectively transfer a driving force generated from the second driving motor 240 to the second drum 210 and the pulsator.

The washing machine 1 may include a second drain pump 270 disposed below the second tub 220 to discharge water in the second tub 220 to the outside of the washing machine 1 and a second drain hose 272 which guides the water pumped by the second drain pump 270 to the outside of the washing machine 1. In detail, the second drain pump 270 may be mounted above the first housing 130.

A second drain hole 273 capable of draining water in the second tub 220 may be formed at a bottom surface of the second tub 220. The second drain hole 273 and the second drain pump 270 may be connected by a second connecting hose 271 to allow the water in the second tub 220 to flow into the second drain pump 270.

The washing machine 1 may include a water supply device 400 capable of supplying washing water to the first tub 120 and the second tub 220. The water supply device 400 may be disposed at the second housing 230. In detail, the water supply device 400 may be disposed at the upper frame 232 or preferably, may be disposed in the rear of the second insertion hole 234.

Also, the washing machine 1 may include a detergent supply device 500 capable of supplying a detergent to the first tub 120. The detergent supply device 500 may be disposed at the second housing 230. In detail, the detergent supply device 500 may be disposed at the upper frame 232 or preferably, may be disposed in the front of the second insertion hole 234.

The washing machine 1 may include a fixing bracket 30 which couples the first housing 130 and the second housing 230 not to be separated. The fixing bracket 30 may be coupled to a front of the first housing 130 and a front of the second housing 230.

Also, the washing machine 1 may include a control panel 50 disposed above the front cover 40 to operate the washing machine 1. The control panel 50 may include an inputter which receives an operation command of the washing machine 1 from the user and a display which displays operation information of the washing machine 1.

The washing machine 1 may include a dryer 600 configured to supply hot air toward an inside of the first drum 110 or an inside of the first tub 120 which surrounds the first drum 110.

Figure 4:
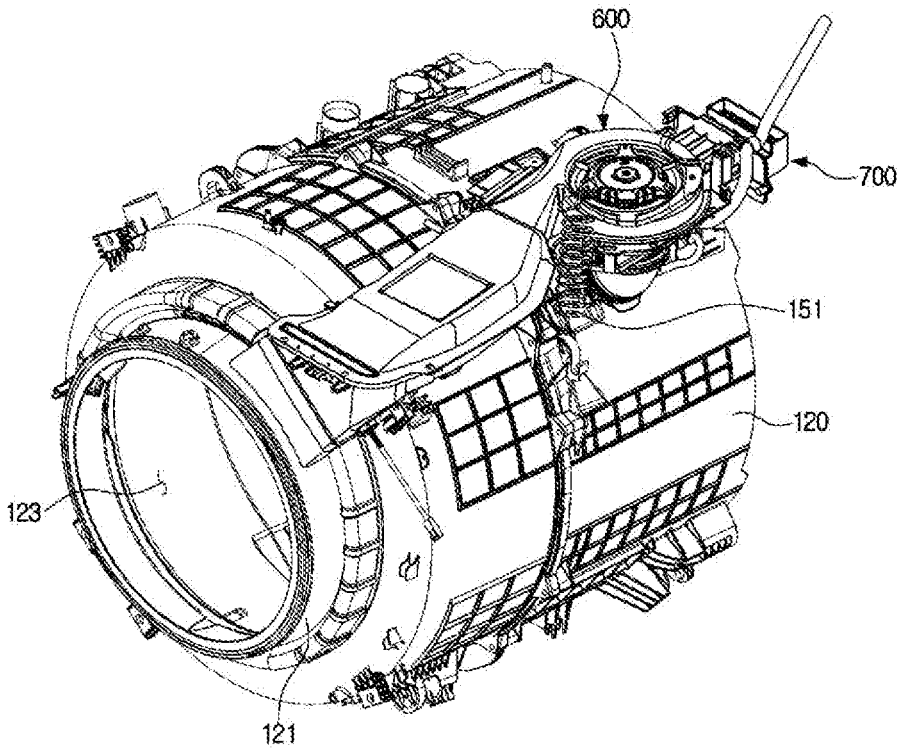
FIG. 4 is a perspective view illustrating a first tub and a dryer of the washing machine shown in FIG. 2.
Figure 5:
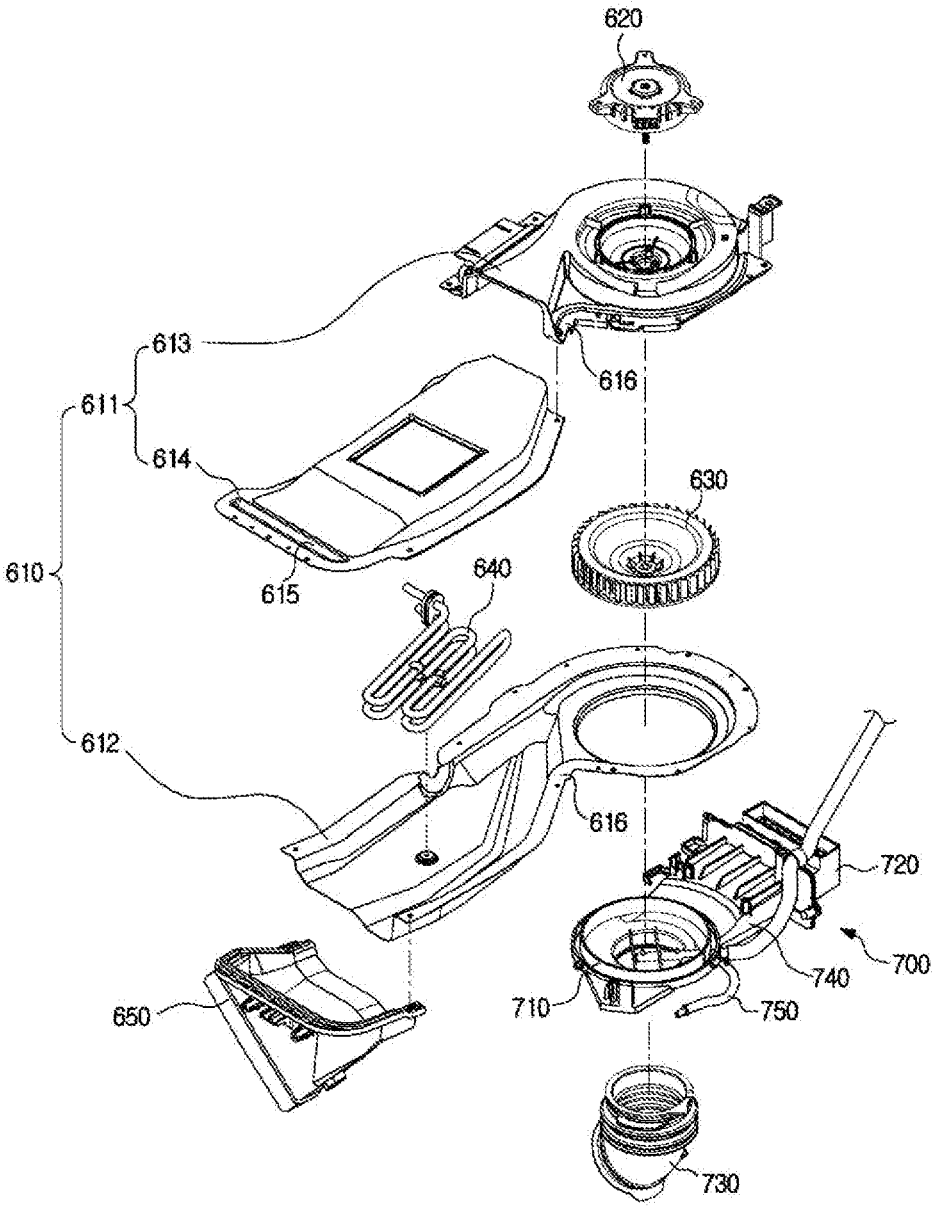
FIG. 5 is an exploded view illustrating the dryer and a connector shown in FIG. 4.

FIG. 4 is a perspective view illustrating the first tub and the dryer of the washing machine shown in FIG. 2. FIG. 5 is an exploded view illustrating the dryer and a connector shown in FIG. 4.

Referring to FIGS. 4 and 5, the dryer 600 may heat and circulate air in the first tub 120 and may partially suction in, heat, and supply air in the first housing 130 and the second housing 230 to the first tub 120. A connector 700 which connects the dryer 600 to the first tub 120 and a suction hose 730 may be provided between the first tub 120 and the dryer 600.

The dryer 600 may include a blowing fan 630 which suctions air in the first tub 120 behind the first tub 120 and blows the air toward a front of the first tub 120 and a heater 640 which heats the air suctioned by the blowing fan 630. The dryer 600 may include a case 610 in which the blowing fan 630 and the heater 640 are disposed and may include a blowing duct 650 which has one end connected to a front bottom of the case 610 and the other end connected to the diaphragm 121 disposed in front of the first tub 120. The case 610 and the blowing duct 650 may form a blowing flow path of the blowing fan 630.

The case 610 of the dryer 600 may include a lower cover 612 adjacent to the first tub 120 and an upper cover 611 coupled to a top of the lower cover 612. The upper cover 611 may include a blowing fan cover 613 disposed near the blowing fan 630 and a heater cover 614 disposed near the heater 640. That is, the heater cover 614 may be disposed in front of the blowing fan cover 613.

The blowing duct 650 may be coupled to a front of the lower cover 612 to allow a top to be opened, and the heater cover 614 may be disposed to cover a part of the lower cover 612 and the blowing duct 650. That is, the blowing duct 650 may be connected to a front of the lower cover 612 and a bottom of the upper cover 611. The lower cover 612 and the heater cover 614, in which the heater 640 is disposed, may include a heat-resistant metal material and may be molded by processing using a press.

A driving motor 620 for driving the blowing fan 630 may be disposed outside the blowing fan cover 613. Also, the case 610 may include a concave part 616 provided to guide an air blowing direction of the blowing fan 630. That is, the concave part 616 may be provided at the blowing fan cover 613 and the lower cover 612 to which the blowing fan cover 613 is coupled.

The connector 700 may be connected below the blowing fan 630 of the dryer 600, and the connector 700 and the first tub 120 may be connected by the suction hose 730. Also, the connector 700 may include an inlet duct 720 into which air in the first housing 130 or the second housing 230 may flow. Accordingly, the dryer 600 may suction in the air in the first tub 120 and the air in the first housing 130 or in the second housing 230 through the connector 700.

Figure 6:
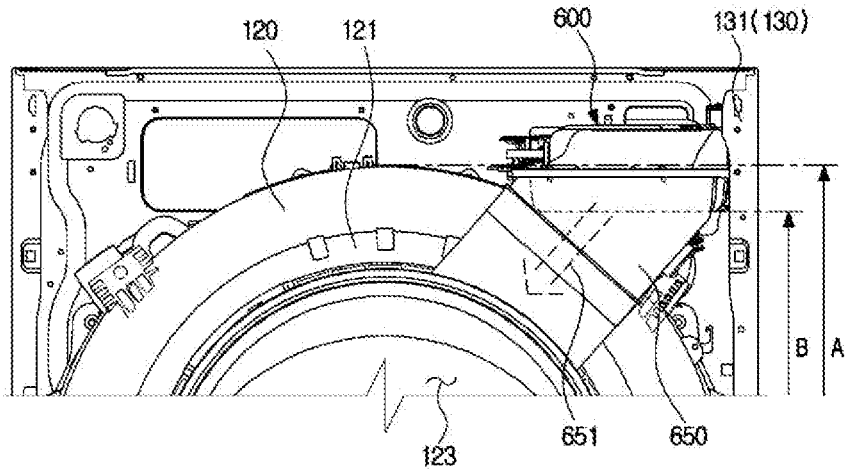
FIG. 6 is a front view illustrating the first tub and the dryer disposed in a first housing of the washing machine shown in FIG. 2.
Figure 7:
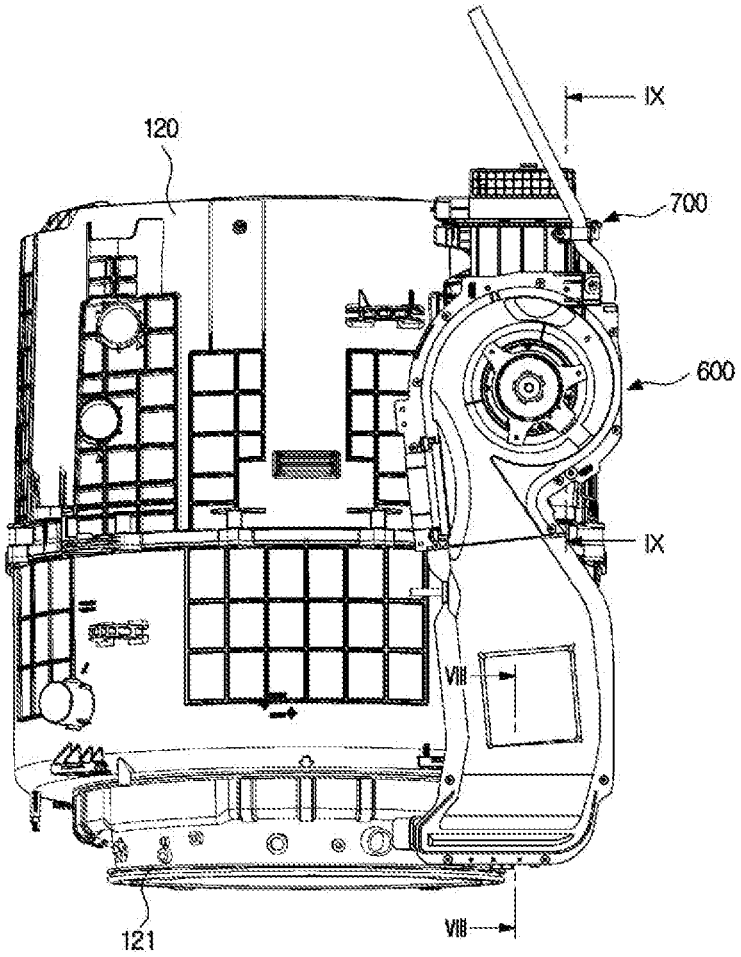
FIG. 7 is a top view illustrating the first tub and the dryer disposed in the first housing of the washing machine shown in FIG. 6.
Figure 8:
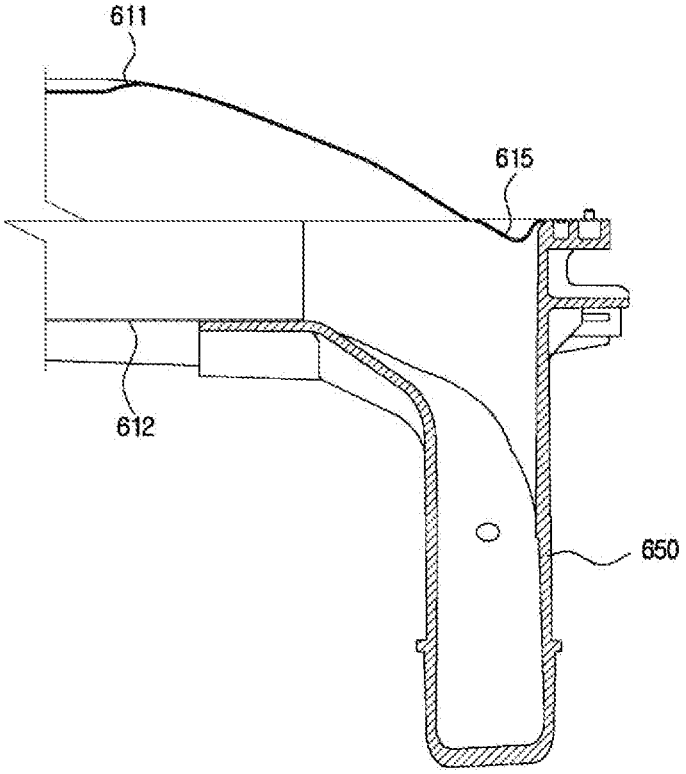
FIG. 8 is an enlarged cross-sectional view illustrating a part of a case of a dryer shown in FIG. 7.
Figure 9:
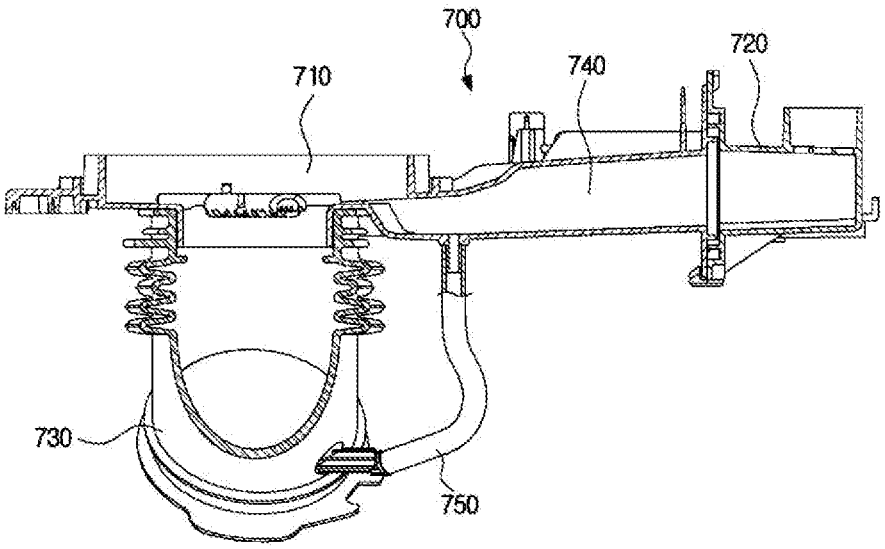
FIG. 9 is an enlarged cross-sectional view illustrating a part of a connector shown in FIG. 7.

FIG. 6 is a front view illustrating the first tub and the dryer disposed in the first housing of the washing machine shown in FIG. 2. FIG. 7 is a top view illustrating the first tub and the dryer disposed in the first housing of the washing machine shown in FIG. 6. FIG. 8 is an enlarged cross-sectional view illustrating a part of a case of the dryer shown in FIG. 7. FIG. 9 is an enlarged cross-sectional view illustrating a part of a connector shown in FIG. 7.

FIG. 8 illustrates a cross section taken along line VIII-VIII shown in FIG. 7. FIG. 9 illustrates a cross section taken along line IX-IX shown in FIG. 7.

FIGS. 6 to 8, in the washing machine 1, the dryer 600 may be disposed above the outside of the first tub 120 to deviate toward one side to allow a height B of a bottom end of the dryer 600 to be disposed at a position lower than a height A of a top end of the first tub 120 to provide a space for disposing the second tub 220 at the top of the first tub 120.

Since the dryer 600 is disposed to deviate toward one side in a center of the first tub 120, the blowing duct 650 of the dryer 600 may be formed to be inclined to allow hot air discharged by the dryer 600 to move toward a center of the opening 123 disposed in front the first tub 120. Also, the upper cover 611 of the dryer 600 connected to a top of the blowing duct 650 may be provided at an end near the blowing duct 650 and may include a drawing part 615 recessed toward the blowing duct 650. In detail, the heater cover 614 of the upper cover 611, provided near the blowing duct 650, may include the drawing part 615 through press-molding.

Flow-resistance of air which flows from the case 610 of the dryer 600 to the blowing duct 650 due to the blowing fan 630 may be reduced by the drawing part 615 provided at the upper cover 611. Also, hot air discharged into the blowing duct 650 may easily flow into the first drum 110 without high flow-resistance due to the blowing duct 650 formed in a direction of an arrow 651 to be inclined toward the center of the opening 123 disposed in front of the first tub 120.

Even when the dryer 600 is disposed to deviate toward one side above the outside of the first tub 120, since the spring 151 which supports the first tub 120 to the first housing 130 may be disposed to pass outside the concave part 616 of the case 610 of the dryer 600, the spring 151 may not be interfered by the dryer 600. That is, even when the dryer 600 is disposed to be adjacent to the first side panel 131 of the first housing 130, the spring 151 may not be interfered by the dryer 600 and be supported by a top of the first side panel 131. Also, the dryer 600 may be disposed in a space formed between the outer surface of the first tub 120 and the first side panel 131 of the first housing 130. Here, the spring 151 may not be interfered by the dryer 600 and be supported by the top of the first side panel 131.

Referring to FIG. 9, the connector 700 may include an inside air inlet 710 into which the air in the first tub 120 flows through the suction hose 730 and an outside air inlet 740 into which the air in the first housing 130 or the second housing 230 flows.

Since the height B of the bottom end of the dryer 600 is disposed at a position lower than the height A of the top end of the first tub 120 to provide a space above the dryer 600, a height of the connector 700 below which the dryer 600 is disposed may be lowered. In detail, a height of a bottom surface of the outside air inlet 740 of the connector 700 may be lower than a height of a bottom surface of the inside air inlet 710.

Washing water may flow into the connector 700 through the suction hose 730 during a washing operation in which the dryer 600 is not used. Here, the washing water which flows into the inside air inlet 710 of the connector 700 may flow into the outside air inlet 740 with the bottom surface at a height lower than that of the inside air inlet 710. Accordingly, a residual water drain hose 750 may be connected to the bottom surface of the outside air inlet 740 to discharge residual water of the washing water. The residual water drain hose 750 may connect the bottom surface of the outside air inlet 740 to the suction hose 730.

Figure 10:
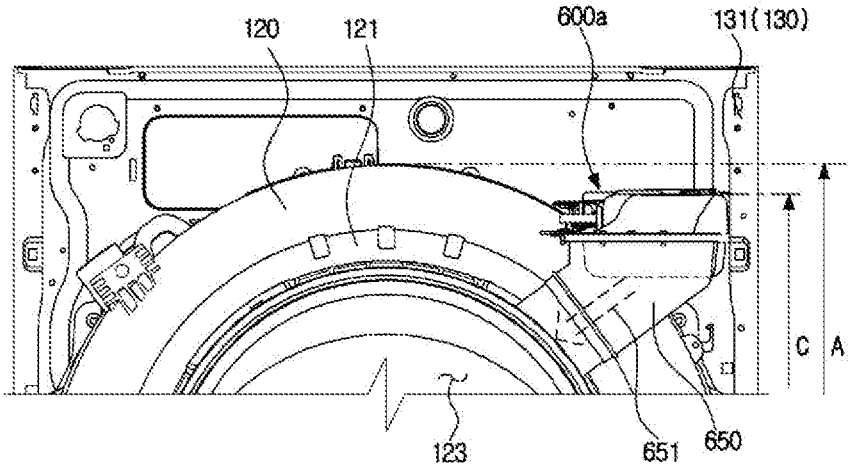
FIG. 10 is a front view illustrating a first tub and a dryer disposed in a first housing of a washing machine according to another embodiment of the present disclosure.

FIG. 10 is a front view illustrating a first tub and a dryer disposed in a first housing of a washing machine according to another embodiment of the present disclosure.

Referring to FIG. 10, a dryer 600*a* may be disposed to allow a height C of a top end thereof to be lower than the height A of the top end of the first tub 120 to provide a much more space above the dryer 600*a* in the first housing 130.

Figure 11:
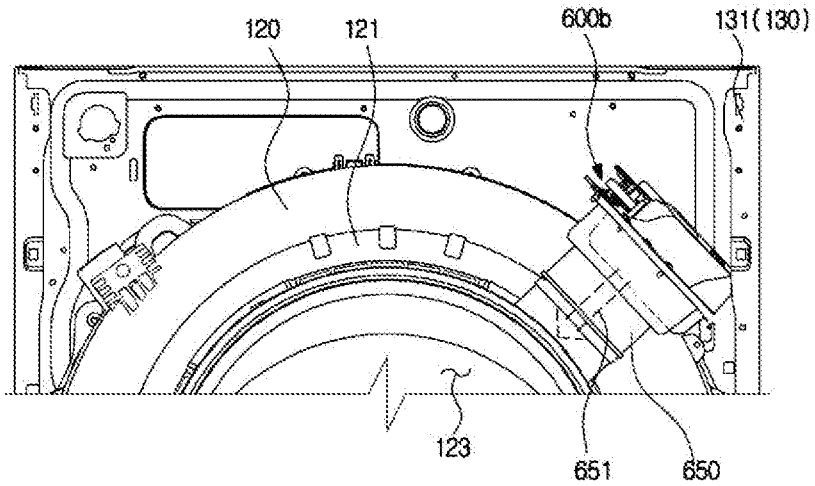
FIG. 11 is a front view illustrating a first tub and a dryer disposed in a first housing of a washing machine according to still another embodiment of the present disclosure.

FIG. 11 is a front view illustrating a first tub and a dryer disposed in a first housing of a washing machine according to still another embodiment of the present disclosure.

Referring to FIG. 11, a dryer 600*b* may be disposed to be inclined to be parallel to a tangential direction of an opening of the first tub 120 to provide a much more space above the dryer 600*b* in the first housing 130. That is, a case of the dryer 600*b* and a blowing fan disposed in the case may be disposed to be inclined to be parallel to the tangential direction of the opening of the first tub 120.

Although only the dryer 600 disposed between the first tub 120 and the second tub 220 has been illustrated and described in the embodiment shown in the drawings, other devices having separate functions such as a hand-washer, a laundry box, an automatic detergent insertion device, a clothes dryer, and the like may be disposed in addition to the second tub 220 in the second housing 230 disposed above the first housing 130 in which the dryer 600 is disposed.

The scope of the present disclosure is not limited to the particular embodiments described above. Various other embodiments correctable or modifiable by one of ordinary skill in the art within a range without departing from the essence as the technical concept of the present disclosure defined by the claims are also included in the scope of the present disclosure.

Although a few embodiments of the present disclosure have been shown and described, it would be appreciated by those skilled in the art that changes may be made in these embodiments without departing from the principles and spirit of the present disclosure, the scope of which is defined in the claims and their equivalents.

The invention claimed is:

1. A washing machine comprising:

a housing;

a tub disposed in the housing;

a drum disposed to be rotatable in the tub;

a dryer configured to supply hot air to an inside of the drum and disposed above the tub to deviate toward one side of the tub with a height of a bottom end of the dryer being lower than a height of a top end of the tub;

a connector which connects the dryer to the tub, and comprises an inside air inlet into which air in the tub flows and an outside air inlet into which air in the housing flows, wherein a height of a bottom surface of the outside air inlet is lower than a height of a bottom surface of the inside air inlet;

a suction hose which connects the inside air inlet of the connector to the tub; and a residual water drain hose which connects the bottom surface of the outside air inlet of the connector to the suction hose.

2. The washing machine of claim 1, wherein a height of a top end of the dryer is lower than the height of the top end of the tub.

3. The washing machine of claim 1, wherein the dryer further comprises:

a case, a fan, inside the case, to suction air in a rear of the tub and blow the suctioned air toward a front of the tub, a duct connected to a front lower portion of the case, and inclined toward a center of an opening disposed at a front of the tub, to guide the blown air toward the center of the opening, and a heater, inside the case, which heats the air suctioned by the fan.

4. The washing machine of claim 3, wherein the case comprises a lower cover and an upper cover, the duct is connected to a front of the lower cover and a bottom of the upper cover, and the upper cover comprises a drawing part provided at an end near the duct and recessed toward the duct.

5. The washing machine of claim 3, further comprising:

a spring which connects an outer surface of the tub to a top of the housing, wherein the case of the dryer comprises a concave part provided to guide a blowing direction of the fan, and the spring is disposed to pass an outside of the concave part of the case.

6. The washing machine of claim 3, wherein the dryer is inclined to allow the fan and the case to be parallel to a tangential direction of the opening of the tub.

7. The washing machine of claim 3, wherein a side of the duct that longitudinally extends in a direction in which the blown air is received into the duct forms an acute angle between an upper portion of the duct forming an inlet of the duct and a lower portion of the duct forming an outlet of the duct, so that the duct is inclined toward the center of the opening.

8. The washing machine of claim 4, wherein the upper cover comprises a fan cover disposed near the fan and a heater cover disposed near the heater, and the heater cover comprising the drawing part comprises a metal material.

* * * * *